US008422338B2

(12) United States Patent
Kuiper et al.

(10) Patent No.: US 8,422,338 B2
(45) Date of Patent: Apr. 16, 2013

(54) SYSTEM FOR VARIABLY REFRACTING ULTRASOUND AND/OR LIGHT

(75) Inventors: Stein Kuiper, Neerijnen (NL); Bernardus Hendrikus Wilhelmus Hendriks, Eindhoven (NL); Jan Frederik Suijver, Dommelen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 573 days.

(21) Appl. No.: 12/376,307

(22) PCT Filed: Apr. 12, 2007

(86) PCT No.: PCT/IB2007/051327

§ 371 (c)(1),
(2), (4) Date: Jul. 21, 2010

(87) PCT Pub. No.: WO2008/023286

PCT Pub. Date: Feb. 28, 2008

(65) Prior Publication Data

US 2010/0290318 A1 Nov. 18, 2010

Related U.S. Application Data

(60) Provisional application No. 60/823,257, filed on Aug. 23, 2006.

(51) Int. Cl.
*G10K 11/30* (2006.01)

(52) U.S. Cl.
USPC ..... 367/138

(58) Field of Classification Search ..... 367/138, 367/128; 600/443; 359/666, 665
See application file for complete search history.

(56) References Cited

U.S. PATENT DOCUMENTS

| | | | | |
|---|---|---|---|---|
| 3,927,557 | A | 12/1975 | Viertl | |
| 3,982,223 | A | 9/1976 | Green | |
| 4,327,738 | A | 5/1982 | Green et al. | |
| 4,718,421 | A | 1/1988 | Rohwedder et al. | |
| 5,305,731 | A | 4/1994 | Buchholtz | |
| 5,419,335 | A | 5/1995 | Hartmann et al. | |
| 7,570,434 | B2 * | 8/2009 | Kuiper et al. | 359/666 |
| 2008/0095498 | A1 * | 4/2008 | Kuiper et al. | 385/40 |
| 2010/0290318 | A1 * | 11/2010 | Kuiper et al. | 367/150 |

FOREIGN PATENT DOCUMENTS

| | | | |
|---|---|---|---|
| DE | 2120593 | | 11/1972 |
| DE | 4120593 | C1 | 9/1992 |
| DE | 3739393 | C2 | 7/1996 |
| EP | 1621135 | A1 | 2/2006 |

(Continued)

OTHER PUBLICATIONS

Faridian, F. and Wickramasinghe, H.K.. "Simultaneous Scanning Optical and Acoustic Microscopy," Electronics Letters, Mar. 3, 1983, vol. 19, No. 5 pp. 159-160.

(Continued)

*Primary Examiner* — Daniel Pihulic

(57) ABSTRACT

The disclosure is directed to a system for variably refracting, and is transparent for, ultrasound as well as for light. By choosing liquids with the right optical and acoustical properties, it is possible to variably refract (including focusing and deflecting or steering) ultrasound while not affecting the refraction of light, or vice versa. Two lenses in series, or preferably one lens, allow for variably refracting ultrasound and light.

17 Claims, 2 Drawing Sheets

FOREIGN PATENT DOCUMENTS

Figure 1:
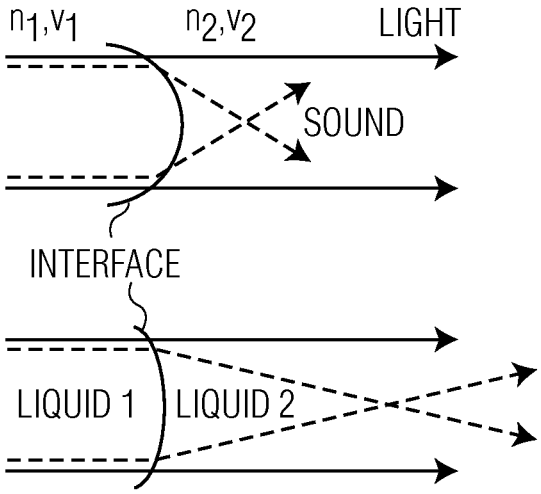

| | | | | |
|---|---|---|---|---|
| JP | 201145195 | A | | 5/2001 |
| JP | 2012155347 | A | * | 8/2012 |
| WO | WO 03069380 | | * | 8/2003 |
| WO | 2004038480 | A1 | | 5/2004 |
| WO | WO 2004051323 | | * | 6/2004 |
| WO | WO 2005122139 | | * | 12/2005 |
| WO | WO2005122139 | A2 | | 12/2005 |
| WO | WO 2006013541 | | * | 2/2006 |
| WO | WO2006030328 | A1 | | 3/2006 |
| WO | WO 2008023286 | | * | 2/2008 |

OTHER PUBLICATIONS

Anonymous: "Philips Fluid Lenses"Digital Photography Review, [Online] Mar. 3, 2004, XP002491852Retrieyed from the InternetURL:http://www.dpreview.com/news/0403/04030302philipsfluidlens.asp [retrieved on Aug. 13, 2008].

* cited by examiner

SYSTEM FOR VARIABLY REFRACTING ULTRASOUND AND/OR LIGHT

CROSS REFERENCE TO RELATED CASES

Applicants claim the benefit of International Application Number PCT/IB2007/051327, filed Apr. 12, 2007, and Provisional Application Ser. No. 60/823,257, filed Aug. 23, 2006.

The disclosure is directed to a system for variably refracting, and is transparent for, ultrasound as well as for light. By choosing liquids with the right optical and acoustical properties, it is possible to variably refract (including focusing and deflecting or steering) ultrasound while not affecting the refraction of light, or vice versa. Two lenses in series, or preferably one lens, allow for variably refracting ultrasound and light.

Techniques for light (i.e., optical) or ultrasound (i.e., acoustic) imaging or treatment of sites within the human body are of current interest. Some techniques may involve using the interface (i.e., boundary) between two liquids as an optical lens, or as an acoustic lens. For some applications it is desirable to use a single lens system for both light and ultrasound. For instance, in an endoscope one may want to image optically as well as acoustically. Also, one may want to image optically and treat acoustically, or image acoustically and treat optically. As space is very limited in currently used medical devices for use within the human body, such as an endoscope, catheter or an ingestible electronic capsule for imaging or treatment, it may be desirable to use the same lens system for both optical and acoustic techniques.

International Publication Number WO 2005/122139 published on Dec. 22, 2005 discloses an acoustic device comprising an acoustic lens with a variable focal length. The acoustic lens comprises a curved boundary between two liquids, typically immiscible, and means (e.g., using electrical or mechanical forces) to vary the shape of the boundary, which in turn varies the focal length of the lens. This publication also discloses that an acoustic wave generator, such as is disclosed in U.S. Pat. No. 5,305,731 issued on Apr. 26, 1994, can optionally be incorporated into the acoustic device. The disclosure of each of this publication and US patent are incorporated by reference herein in their entirety.

Other prior art generally disclosing acoustic devices and use thereof in imaging applications are International Publication Number WO 2006030328 (published Mar. 23, 2006); U.S. Pat. Nos. 4,718,421; 3,927,557; 5,419,335; 3,982,223; and 4,327,738; European Patent Publication 1,621,135 published on Feb. 1, 2006; and German Patents 4,120,593 and 3,739,393.

However, such devices disclosed in the prior art do not overcome the problems associated with using both optical and acoustic imaging or treatment at the same time. In such instances, switching the lens for one of the techniques disturbs the other technique. For instance, one may want to image optically and change the focal length or direction of the acoustic signal. The required change in lens shape for the acoustic signal can cause the optical signal to go out of focus.

These and other needs are satisfied with the variable refracting system of the present disclosure.

According to the present disclosure, a system that is capable of variably refracting ultrasound as well as light is disclosed. By choosing liquids with the right optical and acoustical properties, it is possible to variably refract ultrasound while not affecting the refraction of light, or vice versa. Two lenses in series allow for refracting ultrasound and light.

The term "refracting" is meant to include, but not be limited to, focusing on or off axis, deflection, and steering of the light and/or ultrasonic waves.

Specifically, it is an object of the invention to provide a system that is capable of variably refracting light and/or ultrasound waves, the system comprising at least one lens comprising two immiscible liquids that form a boundary between the liquids, and means for applying a force directly onto at least a part of one of the liquids so as to selectively induce a displacement of part of the boundary.

Another object of the invention is to provide a system that is capable of variably focusing light and/or ultrasound waves.

Another object is to provide a system that is capable of variably deflecting light and/or ultrasound waves.

Another object of the invention is to provide a variable-focus lens system that is capable of variably focusing light and/or ultrasound waves, the system comprising:

a first lens having means for variably-focusing ultrasound waves without substantially refracting light waves; and a second lens having means for variably-focusing light waves without substantially refracting ultrasound waves, wherein the second lens is in series with the first lens.

Another object is to provide a system wherein the system comprises:

the first lens comprising two liquids 1 and 2 having substantially the same refractive index to light waves and in which the ultrasound waves have different velocities, a first boundary between the liquids 1 and 2, and means for applying a force directly onto at least a part of one of the liquids 1 and 2 so as to selectively induce a displacement of part of the first boundary; and the second lens comprising two liquids 2 and 3 having different refractive indices to light waves and in which the ultrasound waves have substantially the same velocity, a second boundary between the liquids 2 and 3, and means for applying a force directly onto at least a part of one of the liquids 2 and 3 so as to selectively induce a displacement of part of the second boundary;

wherein liquids 1, 2 and 3 are in series with one another.

Another object is to provide a system wherein the liquids 1, 2 and 3 have substantially equal densities.

Another object is to provide a system wherein liquid 1 is polydimethylsiloxane 20 cSt; liquid 2 is a mixture of 24% methanol and 76% aniline by weight; and liquid 3 is a mixture of 47% carbon disulfide and 53% benzene by weight.

Another object is to provide a system wherein the liquids 1, 2 and 3 are not miscible with each other, and the first boundary is a first contact meniscus between liquids 1 and 2; and the second boundary is a second contact meniscus between liquids 2 and 3.

Another object is to provide a system wherein the attenuation coefficients of the liquids 1, 2 and 3 are less than about 0.45 decibels per centimeter.

Another object is to provide a system wherein the system comprises:

the first lens comprising two liquids 1 and 2 having substantially the same refractive index to light waves and in which the ultrasound waves have different velocities, a first boundary between the liquids 1 and 2, and means for applying a force directly onto at least a part of one of the liquids 1 and 2 so as to selectively induce a displacement of part of the first boundary; and the second lens comprising two liquids 3 and 4 having different refractive indices to light waves and in which the ultrasound waves have substantially the same velocity, a second boundary between the liquids 3 and 4, and means for applying a force directly onto at least a part of one of the liquids 3 and 4 so as to selectively induce a displacement of part of the second boundary;

wherein liquids 1, 2, 3 and 4 are in series with each other.

Another object is to provide a system wherein the lens comprises two immiscible liquids 1 and 2; wherein liquid 1 has a refractive index for light of $n_1$ and speed of sound of $v_1$, and liquid 2 has a refractive index of $n_2$, and speed of sound of $v_2$, wherein the boundary between the liquids 1 and 2 obeys the relationship:

$$\left|\frac{n_1}{n_2} - \frac{v_1}{v_2}\right| < 0.2;$$

wherein the lens is capable of simultaneously focusing ultrasound and light waves at substantially the same point in space.

Another object is to provide a system wherein:

$$\left|\frac{n_1}{n_2} - \frac{v_1}{v_2}\right| < 0.1.$$

Another object is to provide a system wherein:

$$\frac{n_1}{n_2} = \frac{v_1}{v_2}.$$

Another object is to provide a system wherein:

liquid 1 is cis-decaline, wherein $n_1$ is 1.481 and $v_1$ is 1.42 kilometers/second;

liquid 2 is a mixture of 48.2 weight percent water, and 51.8 weight percent of methanol, wherein $n_2$ is 1.33 and $v_2$ is 1.278 kilometers/second; and $$\left|\frac{n_1}{n_2} - \frac{v_1}{v_2}\right| = 0.$$

Another object is to provide a system wherein:

liquid 1 is 1,1,3,3-tetraphenyl-dimethyldisiloxane, wherein $n_1$ is 1.5866 and $v_1$ is 1.37 kilometers/second;

liquid 2 is a mixture of x weight percent water and (1−x) weight percent of methanol, such that $0<x<0.75$, wherein $n_2$ is 1.33 and $1.09<v_2<1.28$ kilometers/second; and $$\left|\frac{n_1}{n_2} - \frac{v_1}{v_2}\right| < 0.2.$$

Another object is to provide a system wherein:

liquid 1 is cis-decaline, wherein $n_1$ is 1.481 and $v_1$ is 1.42 kilometers/second;

liquid 2 is a mixture of x weight percent water and (1−x) weight percent of methanol, such that $0.22<x<0.79$, wherein $n_2$ is 1.33 and $1.172<v_2<1.40$ kilometers/second; and $$\left|\frac{n_1}{n_2} - \frac{v_1}{v_2}\right| < 0.1.$$

These and other aspects of the invention are explained in more detail with reference to the following embodiments and with reference to the figures.

FIG. 1 conceptually depicts the interface or boundary between two immiscible liquids in two different shapes. Since the refractive indices are equal in the figure, the light rays are undisturbed. The acoustic rays are refracted due to a difference in sound velocity in the liquids.

Figure 2:
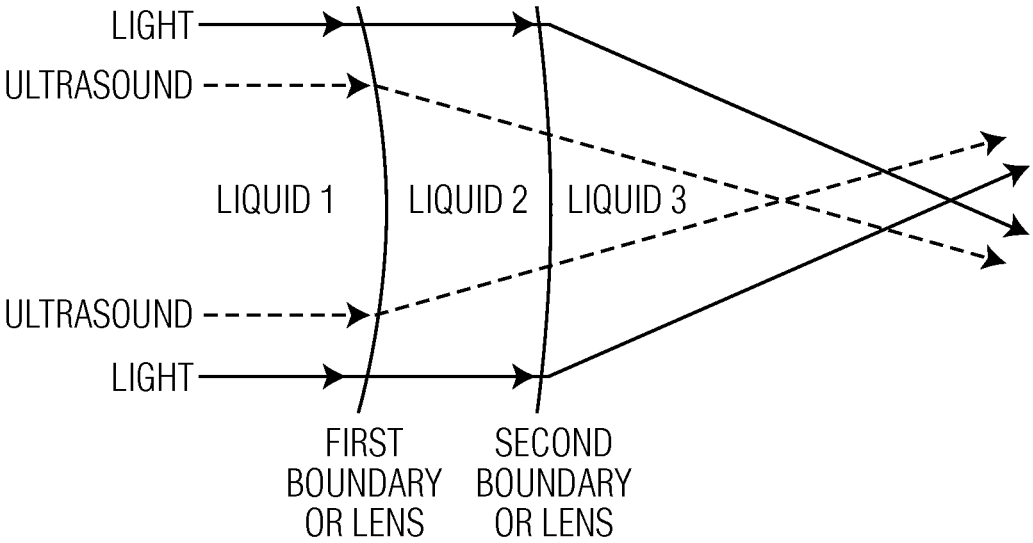

FIG. 2 conceptually depicts three immiscible liquids 1, 2 and 3 in series forming a first boundary or lens between liquids 1 and 2, and a second boundary or lens between liquids 2 and 3. Ultrasound waves are only refracted by the first boundary and light waves are only refracted by the second boundary.

Figure 3:
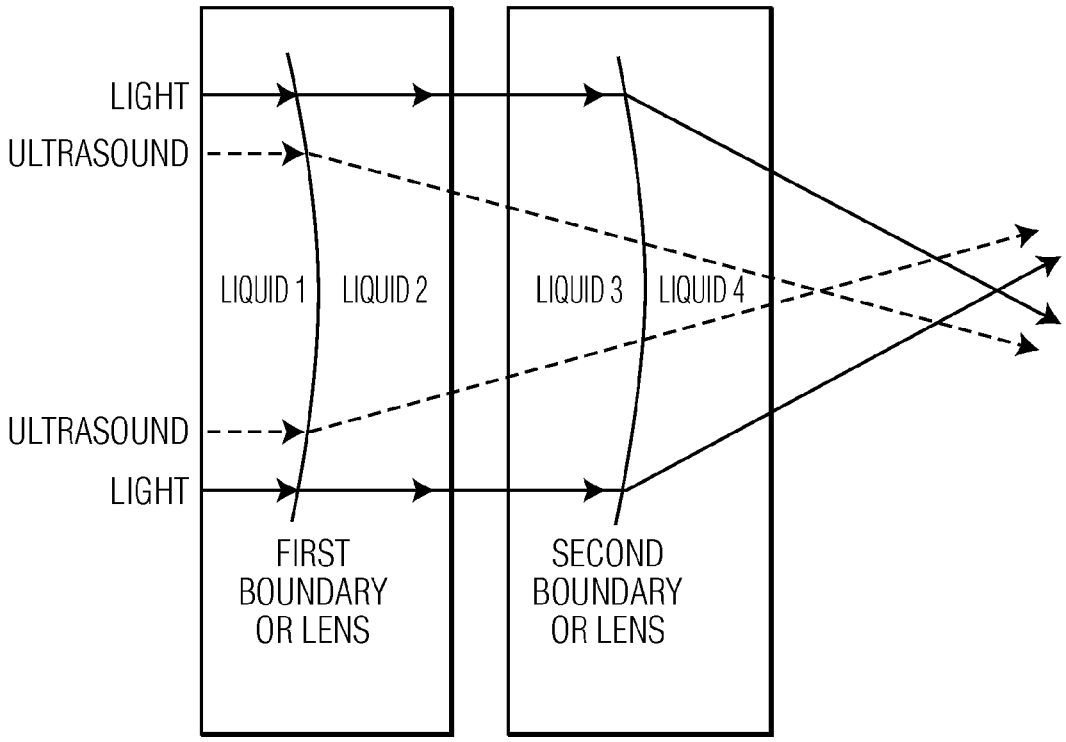

FIG. 3 conceptually depicts four immiscible liquids 1, 2, 3 and 4 in series forming a first boundary or lens between liquids 1 and 2, and a second boundary or lens between liquids 3 and 4. Ultrasound waves are only refracted by the first boundary and light waves are only refracted by the second boundary. There need not be a direct contact between liquids 2 and 3 (e.g.: they may be spatially separated and located in different containers).

Figure 4:
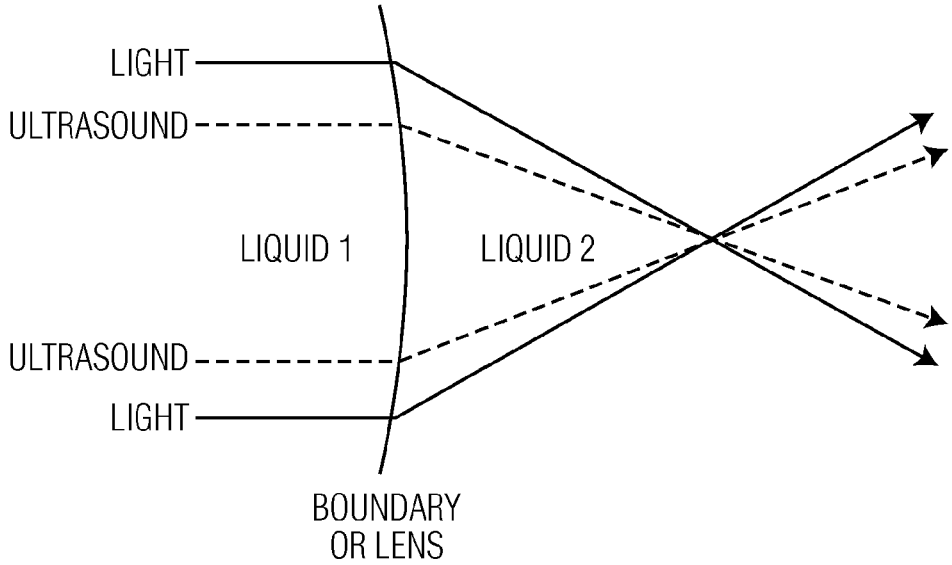

FIG. 4 conceptually depicts two immiscible liquids 1 and 2 in series forming a boundary or lens between liquids 1 and 2. Both light and ultrasound waves are refracted by the boundary to the same point in space.

To overcome the problems associated with the prior disclosed medical devices using ultrasound or light variable-focus lenses, the herein disclosed variable-focus lens is transparent for ultrasound as well as for light. By choosing liquids with the right optical and acoustical properties, it is possible to variably focus the lens for ultrasound while not affecting the refraction of light, or vice versa. Two lenses in series allow for variably focusing ultrasound and light independently.

The lens system according to the invention uses two lenses in series that refracts either optical or acoustic signals and does not refract the other signal. Thus, it either refracts acoustic signals while leaving optical signals undisturbed, or it refracts optical signals and leaves acoustic signals undisturbed. FIG. 1 schematically depicts how an ultrasound wave is refracted whereas the light wave is not. In this instance, liquid 1 has the same refractive index for light as liquid 2; therefore there is no refraction of the light waves. However, the velocity of sound (i.e., the acoustic property) of one liquid is substantially higher than that of the other liquid thereby causing refraction of the ultrasound waves and resulting in a given focal length or point of intersection of the ultrasound waves after passing through the liquids and boundary. If the boundary shape is altered (e.g., by applying an electrical or mechanical force to a portion of the boundary) then the lens focal length changes for the ultrasound waves.

Similarly, if liquids 1 and 2 are chosen such that the velocity of sound is the same for both liquids, but the refractive indices are different, then ultrasound waves will pass through the boundary without refraction, whereas the light waves will be refracted. Again, changing the shape of the boundary will result in a different lens focal length for the light waves.

If a lens system according to the invention is made with two boundaries or menisci in series, both ultrasound and light can be variably focused independently (as is depicted in FIG. 2). Lenses in series do not give rise to a space issue in endoscopy, as an endoscope provides ample space in the axial direction. Two lenses in parallel, one for ultrasound and one for light, would give a problem regarding space, as the diameter of an endoscope is very restricted. This space problem is solved according to the invention disclosed herein.

In one embodiment of the invention having first and second lenses in series (see FIG. 3), namely embodiment 1 below, a first lens is comprised of two immiscible liquids having the same refractive index for light, so that only ultrasound waves are refracted (see Table 1).

The second lens is comprised of two immiscible liquids wherein the velocity of sound waves is the same, so that only light waves are refracted (see Table 2). The first and second lenses can be in close proximity to one another but physically in separate containers or housing or all four liquids can be in the same container or housing with the liquids 2 and 3 also being immiscible or prevented from mixing with each other. Also, it is evident according to the invention that the order of the lenses in series is not critical; for example, the first lens may only refract light waves and the second lens may only refract ultrasound waves, or vice versa.

Embodiment 1

Immiscible liquids with equal refractive index and different sound velocity are for instance:

TABLE 1

Immiscible liquids with equal refractive index and different sound velocity.

| Liquid | Velocity of sound (m/s) | Refractive index | Density (g/cm$^3$) |
|---|---|---|---|
| Polydimethylsiloxane 20 cSt | 947 | 1.40 | 0.95 |
| 50% water/50% glycerol | 1705 | 1.40 | 1.13 |

Immiscible liquids with equal sound velocity and different refractive index are for instance:

TABLE 2

Immiscible liquids with different refractive index and equal sound velocity.

| Liquid | Velocity of sound (m/s) | Refractive index | Density (g/cm$^3$) |
|---|---|---|---|
| Benzene | 1320 | 1.50 | 0.88 |
| 55.6% water/44.4% methanol | 1320 | 1.34 | 0.91 |

For lenses with a diameter larger than a few millimeter it is desirable to match the densities of both liquids in order to make the lens shape gravity independent. The liquids in the second table are already quite close in density (3% difference) . By mixing with more liquids, it is possible to obtain substantially equal densities.

In another embodiment of the invention, namely embodiment 2 below, having three immiscible liquids in series (see FIG. 2), the first two liquids, (i.e., polydimethylsiloxane, or liquid 1; and methanol/aniline, or liquid 2) form the first lens and having the same refractive index resulting in ultrasound refraction, but no light refraction. The second lens formed from the second and third liquids (i.e., methanol/aniline, or liquid 2; and carbon disulfide/benzene, or liquid 3) refracts light waves, but not ultrasound.

Embodiment 2

For the case of two lenses in series, it is possible to make one tube with three liquids and thus two menisci, e.g.: nonpolar liquid 1/polar liquid/nonpolar liquid 2. An example is given in table 3.

TABLE 3

Three liquids that can be used to form two menisci in one tube. The methanol/aniline mixture should be in the middle. The first meniscus refracts sound, the second refracts light.

| Liquid | Velocity of sound (m/s) | Refractive index | Density (g/cm$^3$) |
|---|---|---|---|
| Polydimethylsiloxane 20 cSt | 947 | 1.40 | 0.95 |
| 24% methanol/ 76% aniline | 1250 | 1.40 | 0.97 |
| 47% carbon disulfide/ 53% benzene | 1250 | 1.56 | 1.05 |

The invention is especially useful in instruments with very limited space, such as endoscopes, catheters and ingestible camera pills. In near-future endoscopes and camera pills it is very likely that ultrasonic imaging and/or treatment is combined with optical imaging and/or treatment. Space is very limited in an endoscope. Therefore, it will be ideal if one can scale down the optical and acoustic pathways, so as to fit inside as little volume as possible. However, this should not be at the expense of the focus-quality or the beam-steering range. The solution advocated here is based on having both pathways use the same lens. In order to be able to do this, the acoustic and optical signals must be refracted similarly by the lens. This implies that, if the object moves to a different position or the lens changes shape, both the optical and acoustic signal change to the same extent.

Inside a minimally invasive device for human beings and animals, such as an endoscope, catheter, capsule camera, and the like, there is very limited space. As a result, it is prohibitively impractical to have two separate beam-paths and associated lenses inside such a device. In accordance with a preferred embodiment of the invention, a lens system is provided to allow variable focusing (and, if so desired, steering) of visible light at the same time as ultrasound. In order to do so, it is important to carefully select the constituent media of such a lens. Oftentimes, lenses that work for optical wavelengths tend to absorb all ultrasound frequencies very fast (e.g. ≧25 dB/cm for polyethylene plastics or silicone rubbers), and vice-versa. Furthermore, typical lenses that are actually transparent for both wavelengths tend to have wildly different focal characteristics for optical and ultrasonic frequencies.

When two media with refractive indices $n_1$ and $n_2$ are in contact through a spherical surface (which acts as a lens) with radius R, then the point $l_1$ on one side of the lens is imaged to point $l_2$ on the other side of the lens, as determined through the lens equation, $$-\left(\frac{n_1}{l_1}-\frac{n_2}{l_2}\right)=\frac{n_2-n_1}{R}=K_O, \tag{1}$$

where $K_O$ denotes the optical power. On starting from plane waves (i.e.: $l_1$=□), this reduces to give the focal length of the lens $$f_O=\frac{Rn_2}{n_1-n_2} \tag{2}$$

The similar lens equation for ultrasound frequencies (using speeds of sound $v_1$ and $v_2$) informs one that the acoustic points $l_1$ on one side of the lens and point $l_2$ on the other side are related by $$\frac{v_2}{l_2} - \frac{v_1}{l_1} = \frac{v_2 - v_1}{R} = K_A \quad (3)$$

where $K_A$ denotes the acoustic power. Starting again from plane waves this reduces to $$f_A = \frac{Rv_2}{v_1 - v_2} \quad (4)$$

for the acoustic focal length.

Therefore, one can design a lens containing two media (with refractive indices $n_1$ and $n_2$, and speeds of sound $v_1$ and $v_2$) such that the optical and acoustic foci lie at the same point ($f_O = f_A$), resulting in the requirement that $$\frac{n_2}{n_1 - n_2} = \frac{v_2}{v_1 - v_2} \quad (5)$$

or $$\frac{n_1}{n_2} - \frac{v_1}{v_2} = 0 \quad (6)$$

which no longer depends on the radius of curvature R of the lens. Clearly, this is highly desirable, as this implies that on using the design requirements as indicated in Equation (6) a single lens will focus optical and ultrasound waves at the same position, regardless of the curvature of the lens (see FIG. 4). Also beam steering will work exactly the same for ultrasound and optical wavelengths when Equation (6) is fulfilled.

Therefore, in a third embodiment of the invention a lens is provided containing at least two immiscible media (refractive indices $n_1$ and $n_2$, speeds of sound $v_1$ and $v_2$), where the interface between the media forms the lens, which is characterized in that it substantially complies with $$\frac{n_1}{n_2} = \frac{v_1}{v_2}$$

Such a lens images both ultrasound and visible optical frequencies at substantially the same point in space for any point, both on or off the optical axis.

In a fourth embodiment of the invention a system is provided where the lens is tunable.

In a fifth embodiment a lens is provided with two liquids (refractive indices $n_1$ and $n_2$, speeds of sound $v_1$ and $v_2$) such that they substantially comply with $$\left|\frac{n_1}{n_2} - \frac{v_1}{v_2}\right| < 0.2,$$

which will allow simultaneous focusing and steering of optical and ultrasound frequencies at any point in space.

In a sixth embodiment a lens is provided with two liquids (refractive indices $n_1$ and $n_2$, speeds of sound $v_1$ and $v_2$) such that they more preferably comply with $$\left|\frac{n_1}{n_2} - \frac{v_1}{v_2}\right| < 0.1,$$

which will allow simultaneous focusing and steering of optical and ultrasound frequencies at any point in space.

Typically such embodiments can utilize, but not be limited to, various mixtures of water and methanol, which have almost similar refractive indices, but a large difference in ultrasound velocities (1.48 and 1.09 km/s, respectively) and can be mixed in any ratio desired. A water/methanol mixture has a linearly changing velocity of sound: for an x water and (1−x) methanol mixture, the velocity of sound becomes $$v_{mix} = xv_{water} + (1-x)v_{methanol} = 1.09 + 0.39x \text{[km/s]}$$

For example, for the third and fourth embodiments, using the combination of the liquids cis-decaline ($C_{10}H_{18}$; $n_1$=1.481, $v_1$=1.42 km/s) and a 48.2% water+51.8% methanol mixture (48.2% $H_2O$+51.8% $CH_4O$; $n_2$=1.33, $v_2$=1.278 km/s) results in $$\left|\frac{n_1}{n_2} - \frac{v_1}{v_2}\right| = 0$$

which implies that both ultrasound and optical frequencies are focused at the same point in space (both on or off the optical axis).

For example, for the third, fourth and fifth embodiments, combining a phenylated silicone oil (e.g. 1,1,3,3-Tetraphenyl-dimethyldisiloxane, $C_{26}H_{26}OSi_2$; $n_1$=1.5866, $v_1$=1.37 km/s) and any water+methanol mixture x $H_2O$+(1−x) $CH_4O$ such that 0<x<0.75 ($n_2$=1.33, 1.09<$v_2$<1.28 km/s) results in $$0 = \left|\frac{1.5866}{1.33} - \frac{1.37}{1.151}\right| < \left|\frac{n_1}{n_2} - \frac{v_1}{v_2}\right| < \left|\frac{1.5866}{1.33} - \frac{1.37}{1.38}\right| = 0.199 < 0.2$$

For example for the third, fourth and sixth embodiments, using a combination of cis-Decaline ($C_{10}H_{18}$; $n_1$=1.481, $v_1$=1.42 km/s) and any water+methanol mixture x H2O+(1−x) CH4O such that that 0.22<x<0.79 ($n_2$=1.33, 1.172<$v_2$<1.40 km/s) we find that $$0 = \left|\frac{1.481}{1.33} - \frac{1.42}{1.275}\right| < \left|\frac{n_1}{n_2} - \frac{v_1}{v_2}\right| < \left|\frac{1.481}{1.33} - \frac{1.42}{1.40}\right| = 0.099 < 0.1$$

A dual optical/ultrasound lens such as disclosed herein would be highly attractive in the minimally invasive field. Due to the small size, applicability in e.g. a camera pill will be a logical choice within the whole gamut of bio-medical applications. For instance, such a lens will allow to focus a laser beam for surgery (cutting) purposes, while the cut is being imaged with ultrasound at the same time. The lens system can also refract light and/or ultrasound. It is also contemplated to include the steering and off-axis focusing of light and/or ultrasound. Clearly, for a minimally invasive application this is an advantage; one can, for example, image optically, while simultaneously burning a predetermined trajectory using focused ultrasound.

According to the invention it is preferred that each of the liquids in the lenses, such as liquids 1, 2, 3 and 4, have sufficiently low optical absorbance in the visible spectral range (typically substantially near zero) and ultrasound attenuation coefficients of less than about 0.2 decibels/centimeter (dB/cm) at a frequency of 5 megahertz (MHz); more desirably the attenuation coefficients are substantially close to zero. The attenuation coefficient is simply how fast the ultrasound loses its intensity as a result of absorption in the liquid. Such coefficient values can be found in standard table books or measured with a simple setup.

Some Examples:

Water=0.00825 dB/cm

Methanol=0.026 dB/cm polydimethylsiloxane=~0.45 dB/cm x weight percent water and (1−x) weight percent of methanol=~0.015 dB/cm 24% methanol and 76% aniline=~0.01 dB/cm 1,1,3,3-tetraphenyl-dimethyldisiloxane=~0.4 dB/cm Acoustic variable-focus lenses and means for rapidly adjusting the focal length thereof are disclosed in PCT publication WO 2005/122139 aforementioned, the disclosure of which is incorporated by reference in its entirety herein. This publication teaches that preferably, the two fluid media or liquids of the lens have substantially equal densities. Then, the displacement of the part of the boundary is independent of gravitation, and thus independent of the orientation of the lens system. When the two fluid media are not miscible with each another, the boundary is a contact meniscus between the two fluid media. In this case, no wall is placed between both fluid media. Alternatively, the boundary between the different liquids comprises an elastic film. Such film prevents both fluid media from mixing with each another, and it can be stretched by relatively small forces. The lens may also comprise another elastic film, the two elastic films being arranged to hold one of the two fluid media at two respective locations of a path of the acoustic waves. A higher power value of the lens can thus be achieved.

The means for applying the force directly onto at least part of one of the fluid media can be of several types. According to a first type, a first one of the two fluid media comprises a polar and/or electrically conductive liquid substance, and the force applying means comprise an electrode arranged to apply an electric force onto at least part of said first fluid medium. Such means are adapted for electronically controlling the displacement of the boundary. Very rapid variations of the focal length of the acoustic lens can thus be obtained. The electric force is applied advantageously on a part of the first fluid medium which is adjacent the boundary. Then the whole quantity of first fluid medium may be reduced.

According to a second type, the force applying means comprise a movable body contacting said part of the fluid medium. In an optimized embodiment of this type, the movable body may comprise a wall of a vessel containing said part of the fluid medium.

The lens system can be incorporated into a device designed for imaging an object located outside the device. Then the device would further include an acoustic wave generator such as is disclosed in U.S. Pat. No. 5,305,731, the disclosure of which is incorporated by reference in its entirety herein.

While the present invention has been described with respect to specific embodiments thereof, it will be recognized by those of ordinary skill in the art that many modifications, enhancements, and/or changes can be achieved without departing from the spirit and scope of the invention. Therefore, it is manifestly intended that the invention be limited only by the scope of the claims and equivalents thereof.

The invention claimed is:

1. A system for variably refracting at least one of light and ultrasound waves, the system comprising:

at least one lens comprising two immiscible liquids that form a boundary between the liquids; and a forcing unit configured to apply a force directly onto at least a part of one of the liquids so as to selectively induce a displacement of part of the boundary, wherein the at least one lens comprises:

a first lens including two immiscible liquids having velocities of sound and refractive indices that are selected for variably refracting ultrasound waves without substantially refracting light waves; and a second lens including two immiscible liquids having velocities of sound and refractive indices that are selected for variably refracting light waves without substantially refracting ultrasound waves.

2. The system of claim 1, wherein the forcing unit is further configured to variably focus at least one of light and ultrasound waves.

3. The system of claim 1, wherein the forcing unit is further configured to variably deflect at least one of light and ultrasound waves.

4. A system for variably refracting at least one of light and ultrasound waves, the system comprising:

at least one lens comprising two immiscible liquids that form a boundary between the liquids; and means for applying a force directly onto at least a part of one of the liquids so as to selectively induce a displacement of part of the boundary;

wherein the at least one lens comprises:

a first lens having means for variably-focusing ultrasound waves without substantially refracting light waves; and a second lens having means for variably-focusing light waves without substantially refracting ultrasound waves, wherein the second lens is in series with the first lens.

5. The system of claim 4 wherein the system comprises:

the first lens comprising two liquids 1 and 2 having substantially the same refractive index to light waves and in which the ultrasound waves have different velocities, a first boundary between the liquids 1 and 2, and means for applying a force directly onto at least a part of one of the liquids 1 and 2 so as to selectively induce a displacement of part of the first boundary; and the second lens comprising two liquids 2 and 3 having different refractive indices to light waves and in which the ultrasound waves have substantially the same velocity, a second boundary between the liquids 2 and 3, and means for applying a force directly onto at least a part of one of the liquids 2 and 3 so as to selectively induce a displacement of part of the second boundary;

wherein liquids 1, 2 and 3 are in series with one another.

6. The system of claim 5 wherein the liquids 1, 2 and 3 have substantially equal densities.

7. The system of claim 5 wherein the liquids 1, 2 and 3 are not miscible with each other, and the first boundary is a first contact meniscus between liquids 1 and 2; and the second boundary is a second contact meniscus between liquids 2 and 3.

8. The system of claim 5 wherein the attenuation coefficients of the liquids 1, 2 and 3 are less than about 0.45 decibels per centimeter.

9. The system of claim 4 wherein the system comprises: the first lens comprising two liquids 1 and 2 having substantially the same refractive index to light waves and in which the ultrasound waves have different velocities, a first boundary between the liquids 1 and 2, and means for applying a force directly onto at least a part of one of the liquids 1 and 2 so as to selectively induce a displacement of part of the first boundary; and the second lens comprising two liquids 3 and 4 having different refractive indices to light waves and in which the ultrasound waves have substantially the same velocity, a second boundary between the liquids 3 and 4, and means for applying a force directly onto at least a part of one of the liquids 3 and 4 so as to selectively induce a displacement of part of the second boundary;

wherein liquids 1, 2, 3 and 4 are in series with each other.

10. The system of claim 1 wherein the lens comprises two immiscible liquids 1 and 2; wherein liquid 1 has a refractive index for light of $n_1$ and speed of sound of $v_1$ and liquid 2 has a refractive index of $n_2$, and speed of sound of $v_2$, wherein the boundary between the liquids 1 and 2 obeys the relationship:

$$\left|\frac{n_1}{n_2} - \frac{v_1}{v_2}\right| < 0.2;$$

wherein the lens is capable of simultaneously focusing ultrasound and light waves at substantially the same point in space.

11. The system of claim 10 wherein:

$$\left|\frac{n_1}{n_2} - \frac{v_1}{v_2}\right| < 0.1.$$

12. The system of claim 10 wherein:

$$\frac{n_1}{n_2} = \frac{v_1}{v_2}.$$

13. The system of claim 11 wherein:

liquid 1 is cis-decaline, wherein $n_1$ is 1.481 and $v_1$ is 1.42 kilometers/second;

liquid 2 is a mixture of 48.2 weight percent water, and 51.8 weight percent methanol, wherein $n_2$ is 1.33 and $v_2$ is 1.278 kilometers/second; and $$\left|\frac{n_1}{n_2} - \frac{v_1}{v_2}\right| = 0.$$

14. The system of claim 11 wherein:

liquid 1 is 1,1,3,3-tetraphenyl-dimethyldisiloxane, wherein $n_1$ is 1.5866 and $v_1$ is 1.37 kilometers/second;

liquid 2 is a mixture of x weight percent water and (1−x) weight percent of methanol, such that $0<x<0.75$, wherein $n_2$ is 1.33 and $1.09<v_2<1.28$ kilometers/second; and $$\left|\frac{n_1}{n_2} - \frac{v_1}{v_2}\right| < 0.2.$$

15. The system of claim 11 wherein:

liquid 1 is cis-decaline, wherein n is 1.481 and $v_1$ is 1.42 kilometers/second;

liquid 2 is a mixture of x weight percent water and (1−x) weight percent of methanol, such that $0.22<x<0.79$, wherein $n_2$ is 1.33 and $1.172<v_2<1.40$ kilometers/second; and $$\left|\frac{n_1}{n_2} - \frac{v_1}{v_2}\right| < 0.1.$$

16. The system of claim 6 wherein liquid 1 is polydimethylsiloxane 20 cSt; liquid 2 is a mixture of 24% methanol and 76% aniline by weight; and liquid 3 is a mixture of 47% carbon disulfide and 53% benzene by weight.

17. The system of claim 1 wherein the second lens is in series with the first lens.

* * * * *